US008771502B2

(12) United States Patent
Blackbourn et al.

(10) Patent No.: US 8,771,502 B2
(45) Date of Patent: Jul. 8, 2014

(54) CLOSED LOOP SOLVENT EXTRACTION PROCESS FOR OIL SANDS

(75) Inventors: Robert Lawrence Blackbourn, Houston, TX (US); Reinhard Alfred Bott, Waldbronn (DE); Steven Paul Giles, Damon, TX (US); Bradley Dean Komishke, Calgary (CA); Yicheng Long, Calgary (CA); Ingmar Hubertus Josephina Ploemen, SJ Moerdijk (NL); Bernardus Cornelis Maria IN' T Veen, Amsterdam (NL)

(73) Assignee: Shell Oil Company, Houston, TX (US)

( * ) Notice: Subject to any disclaimer, the term of this patent is extended or adjusted under 35 U.S.C. 154(b) by 299 days.

(21) Appl. No.: 12/887,352

(22) Filed: Sep. 21, 2010

(65) Prior Publication Data

US 2011/0127197 A1 Jun. 2, 2011

(30) Foreign Application Priority Data

Sep. 29, 2009 (CA) ..... 2679908

(51) Int. Cl.
*C10G 1/04* (2006.01)

(52) U.S. Cl.
CPC ..... *C10G 1/045* (2013.01); *C10G 1/04* (2013.01)
USPC ..... 208/390

(58) Field of Classification Search
USPC ..... 208/390, 391
See application file for complete search history.

(56) References Cited

U.S. PATENT DOCUMENTS

| | | | | |
|---|---|---|---|---|
| 3,475,318 | A | 10/1969 | Gable et al. | 208/11 |
| 3,542,666 | A | 11/1970 | Simpson | 208/11 |
| 4,362,213 | A * | 12/1982 | Tabor | 166/267 |
| 4,539,097 | A * | 9/1985 | Kelterborn et al. | 208/390 |
| 4,741,806 | A * | 5/1988 | Scinta | 196/14.52 |
| 2008/0210602 | A1 * | 9/2008 | Duyvesteyn | 208/390 |

FOREIGN PATENT DOCUMENTS

| | | | |
|---|---|---|---|
| CA | 2235938 | * 10/1998 | |
| CA | 2350907 | 5/2000 | C10G 1/04 |
| CA | 2521248 | 3/2007 | B03B 9/02 |

* cited by examiner

*Primary Examiner* — Randy Boyer
*Assistant Examiner* — Brandi M Doyle

(57) ABSTRACT

The present invention is directed to a method comprising contacting an oil sand with a suitable solvent to generate a solvated oil sand slurry; separating solvent-diluted bitumen from the solvated oil sand slurry to generate (a) a solvent-diluted bitumen and (b) a slurry with increased solids concentration; and filtering the slurry with increased solids concentration. The method of the present invention may be used to produce a low ash bitumen product and dry tailings from oil sands.

25 Claims, 1 Drawing Sheet

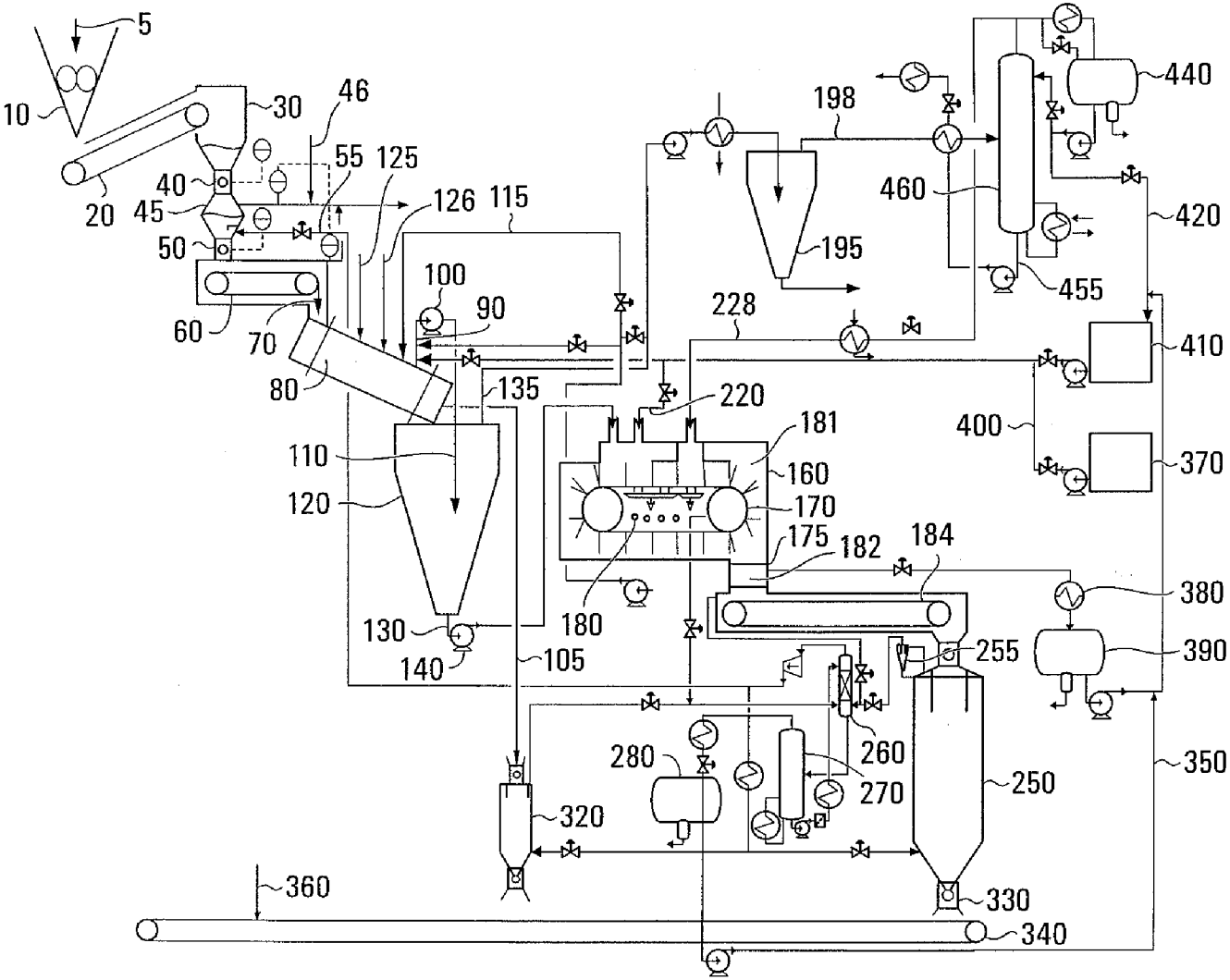
440
420
410
370
380
390
350
455
400
460
198
195
228
220
181
160
170
175
182
184
255
250
330
340
260
270
280
320
180
105
135
115
126
125
100
90
130
140
110
120
80
70
60
46
55
30
40
45
50
5
20
10
360

CLOSED LOOP SOLVENT EXTRACTION PROCESS FOR OIL SANDS

FIELD OF THE INVENTION

This invention relates to a solvent-based process for the extraction of bitumen from oil sands. The process can be used to generate a low-ash bitumen product and dry tailings.

BACKGROUND OF THE INVENTION

In a typical surface-mined oil sand processing operation to produce bitumen, the oil sand is usually crushed to reduce the size of oil sand lumps. The crushed oil sand is mixed with water (e.g. in a rotary breaker) to form a slurry of bitumen, mineral solids and water, as well as to remove lumps of clay, rocks and unablated oil sand over a specified size (e.g. 2" diameter). Then the ore/slurry is conditioned, for example, in a hydro-transportation pipeline or other conditioning means. The conditioned slurry is introduced into a primary separation vessel in which aerated bitumen droplets are separated from a bottom stream consisting primarily of water and solids. The aerated bitumen droplets are recovered as bitumen froth. The bottom stream is treated to recover as much water as possible from the final process outlet stream that is generally referred to as tailings.

The bitumen froth typically contains about 60% by weight bitumen. The remainder is mainly made up of water and solids. The froth is typically treated by adding a solvent and/or other agents, which promotes the separation of bitumen from the other components of the froth. For example, in paraffinic froth treatment processes, the bitumen froth may be mixed with a paraffinic solvent (e.g., pentane or hexane or a mixture of both) in a multi-stage counter-current decantation (CCD) process circuit (see, for example, Canadian Patent Application Nos. 2,350,907 and 2,521,248, the disclosures of which are incorporated herein by reference, which describe paraffinic froth treatment processes including CCD). In a CCD process, the bitumen froth is typically separated into:

1) a dilute bitumen phase (dilbit), mainly comprising solvent and high value components of the bitumen, known as maltenes, and dissolved asphaltenes;
2) an aqueous phase, comprising mainly water, water-soluble materials and dispersed fine solids, such as clays;
3) an inorganic particulate phase, mainly comprising sand; and
4) an organic particulate phase, mainly comprising precipitated asphaltenes, with water and clays incorporated into the aggregate structure of the asphaltenes.

A dilute bitumen phase which is partially deasphalted and substantially free of mineral solids and water is produced as overflow in the CCD process. An aqueous phase comprising water, mineral solids, and rejected asphaltenes may be withdrawn from the CCD circuit as underflow.

The underflow obtained from the CCD process, the CCD tailings, also contains solvent. The solvent can be recovered from the CCD tailings in a tailings solvent recovery unit and the remaining underflow containing water, mineral solids and precipitated asphaltenes is deposited into a tailings pond.

Most oil sands processing operations generally result in substantial volumes of wet tailings. The wet tailings require significant handling expenditures and severely constrain overall mine planning flexibility. In addition, wet tailings present an environmentally challenging situation. In many current open-pit mining operations, waste streams are disposed of by pipelining the waste stream slurry to an external tailings confinement facility or pond, also known as a tailings pond, which is essentially a man-made pond enclosed within a dyke system that contains the waste material. Poor settling characteristics of fine inorganic solids in the containment facility or pond create an uppermost solids layer that has limited bearing capacity. The low bearing capacity of the top layer of the tailings ponds presents a technical barrier to reclaiming mined surfaces because the top layer cannot be covered with overburden using heavy earth moving machinery.

In addition to problems associated with wet tailings, many of the oil sands processing operations currently being employed use large amounts of input water. The input water is usually drawn from natural sources such as rivers that must also provide sufficient volumes to meet the competing needs of nearby communities and industrial entities. Therefore, it would be desirable to use a process for extracting bitumen from oil sands which does not employ large quantities of water.

Since as early as the 1920s, there have been many attempts to develop a non-aqueous extraction process that could be used in the oil sands mining industry. A non-aqueous extraction process could potentially reduce or eliminate the need for added process water, and result in the production of dry tailings. Dry tailings are more amenable to land reclamation efforts as compared to wet tailings. However, none of the proposed non-aqueous extraction processes have proven to be commercially viable or have addressed certain technical limitations inherent in each proposed solution.

SUMMARY OF THE INVENTION

According to an aspect of the present invention, there is provided a method for extracting bitumen from an oil sand, the method comprising contacting an oil sand with a suitable solvent to generate a solvated oil sand slurry; separating solvent-diluted bitumen from the solvated oil sand slurry to generate (a) a solvent-diluted bitumen and (b) a slurry with increased solids concentration; and filtering the slurry with increased solids concentration.

According to one embodiment of the present invention, there is provided a method for extracting bitumen from an oil sand, the method comprising reducing the size of an oil sand feed; adding a suitable solvent to the size-reduced oil sand feed to form a slurry; feeding the slurry to a separation device; allowing the slurry to be separated into a solvent-diluted bitumen and an underflow; feeding the underflow to a filtration unit; recovering a filtrate from the filtration unit; recovering solids from the filtration unit; and recovering solvent.

BRIEF DESCRIPTION OF FIGURES

FIG. 1 is a flow scheme of an example of a solvent based extraction process comprising two settlers in series and a filtration unit according to one embodiment of the present invention.

DETAILED DESCRIPTION OF THE INVENTION

The present invention relates to a method and process for extracting bitumen from oil sands using a combination of conditioning, solvation, primary liquid/solid separation (using, for example, settlers or hydrocyclones) and filtration unit operations. It has been observed that by using a method involving these processing steps, a low-ash bitumen product may be produced, along with dry, substantially solvent-free tailings. For example, low ash bitumen may comprise less than 0.1 weight % ash. Producing a bitumen product with low ash content has considerable advantages as it enables the use of high value adding hydro-processing upgrading operations in the refinery operations downstream of the extraction process. The dry tailings may be backfilled into the mine directly. By "dry", it is meant that the tailings are substantially free of solvent and water.

A rotary breaker is generally used in oil sands processing operations to reduce the size of some of the larger oil sand lumps to more processable material, and to exclude or reject some of the larger lumps and rocks that may hinder downstream processing. Generally, the breaker also solvates and conditions the size-reduced oil sand feed.

Other equipment of comparable functionality to a rotary breaker can also be used, such as, for example, a rotary scrubber, screw washer, mechanical mixer, spiral classifier, log washer, or vibrating screener. The solvent-diluted oil sand slurry from the rotary breaker would generally be a rather thin slurry (e.g. low in solids concentration). If a thin slurry from a rotary breaker would be fed to a filtration unit directly, solids segregation or "classification" may occur. Classification, as would be understood by a person skilled in the art, means that the slurry separates in two phases, a layer of coarse solid particles at the bottom and a layer of supernatant liquid with dispersed fine particles at the top. The fines in this supernatant liquid layer may lead to the formation of a layer of fine solids on top of the filter bed during filtration, which may lead to plugging of the filter bed or strongly reduced filtration rates. A thick slurry, which has a high concentration of solids, may reduce or eliminate the creation of this supernatant liquid layer with dispersed fines and lead to improved filtration rates by helping to prevent plugging of the filter bed. Accordingly, a pre-treatment of the oil sand slurry before feeding to the filtration unit is desirable to increase the concentration of slurry solids so as to produce a thick slurry. In the present invention, this pre-treatment may be accomplished by the use of a solids-liquid separation device such as a settler following the rotary breaker. The settling operation could optionally be performed by hydrocyclones.

The use of filters has been suggested (see, for example, U.S. Pat. No. 3,475,318 and U.S. Pat. No. 3,542,666). However, many of these filters suffer from fines classification during filtration, leading to prolonged filtration times, the need for additives to enhance filtration times, and unrealistic equipment sizes and/or uneconomical numbers of filters. Also, the filtrate product from filters known to date would not generally be low in ash content and, as a result, would require post-treatment to produce a final bitumen product with a low ash content.

On the other hand, the complete absence of a filter in the process may necessitate a CCD-type process or moving-bed process to achieve sufficient washing of the bitumen from the oil sand slurry. It is believed that a CCD-type process would require a large number of stages to achieve sufficient washing and a moving-bed process may not be feasible at the large scale required in oil sands operations.

The combination of a settler and a filtration unit in series may be used in the production of a low ash bitumen from a solvated oil sand slurry. The use of the combination of a settler and a filtration unit in series may result in high bitumen recovery, the production of a bitumen product with low ash content and the removal of solvent from the oil sands. A special advantage of the proposed method is that for oil sands with a low bitumen content higher bitumen recovery may be achieved than with the conventional water based extraction technology.

The filtration unit operation also serves as a combined washer/desolventiser of the process stream. A filtration unit can both wash the bitumen away from the solid materials, and also partially desolventise the solids, i.e. the filter cake. If the majority of solvent is not removed from the solids as a liquid, excessive amounts of vapour may be generated during drying of the solids material by evaporation downstream. The excessive vapour may cause severe erosion problems in the drying equipment. Moreover, evaporating large amounts of solvent generally requires high energy consumption. A filtration unit can be used to provide a continuous processing option to extract the majority of the solvent as liquid during the filtration operation, thereby addressing problems associated with excessive vapour during the drying stage.

Feeding a thick slurry to the filtration unit helps to ensure that the slurry is homogeneous and may assist in preventing blockage of the filter bed. Ideally, the solids content in the slurry should be high enough to ensure that classification does not take place after loading the slurry into the filtration unit. Coarse solid particles in the slurry tend to settle at lower solids concentrations, and thereby leave a layer of supernatant liquid with dispersed fine particles on top. The fine particles in this supernatant liquid layer may block the filter bed during filtration. A thick slurry would be less likely to classify when being loaded on the filter medium. The filter medium may be a layer of cloth or screen that lays on the filter pan, and which has a nominal opening for passage of the filtrate from the thick slurry. For example, a filter medium may have a 10-500-micron opening through which the thick slurry would be separated into a filtrate and a solids portion or filter cake that remains on the filter medium.

A thick slurry may generally be a non-classifying slurry and therefore, suitable for use in filtration operations. A person skilled in the art would be able to determine a suitable solids content for the oil sand slurry. The solids content may, for example, depend on the type and duration of the subsequent filtration step and the particle size distribution of the oil sand. A person skilled in the art would be able to determine suitable solids content through routine experimentation. For example, a solids content of 65 to 85% weight/total mass may be fed to the filtration unit to help prevent classification of solids.

The oil sands extraction processes of the present invention may employ C3 to C9 paraffinic solvents, isomers and/or combinations thereof. For example, solvents such as pentane or hexane may be used. Non-paraffinic solvents, such as aromatic or halogenated solvents, which can dissolve all asphaltenes, would generally not be suitable. When the asphaltenes are dissolved, there will likely be a dispersion of many fine clay particles. Accordingly, using non-paraffinic solvents such as aromatic or halogenated solvents would likely result in extremely low settling rates making producing a low ash product in the settler unfeasible. Also, filtration behaviour may be negatively influenced through the large amount of very fine clay particles.

In one embodiment, a C5 solvent or mixtures of C5 solvents may be used.

The solvent-to-bitumen (S/B) mass ratio at the overflow of the first stage settler may play a role in the subsequent filtration performance of the solvated oil sand slurry and in overall bitumen recovery. Lower S/B ratios may lead to higher dissolution of asphaltenes, and less aggregation of clay particles with decreased settling and filtration performance. Higher S/B ratios may increase equipment size and energy consumption in the solvent/bitumen separation step. Higher S/B ratios may also result in the recovery of less asphaltenes into the final bitumen product. An S/B ratio of 1.0 to 5 may be used. In one embodiment, a ratio of 1.5 to 3 may be used. The skilled person will be able to determine whether a solvent or mixture of solvents is suitable, and whether the S/B ratio is suitable, through routine experimentation, which will depend in part on the availability of particular solvents.

1. Primary Size Reduction

The method and process of extracting bitumen according to the present invention usually begins with a primary size reduction step, which may be used in order to reduce the size of the mined oil sands and deliver the material suitable for further processing (size reduction, classification, extraction) to the closed loop extraction process. The primary size reduction can be carried out in a rotary crusher on a very large scale. Crushers are used extensively in the oil sands processing industry for reducing the size of the fresh mined ore. Generally, the ore may be reduced in size to about 8". The size-reduced material from the crusher may be conveyed to a surge bin(s) for further processing.

2. Entry of Solids into the System

The primary size-reduced oil sands are then fed from a primary surge bin into a hydrocarbon-containing environment for extraction. The oil sands are added in a controlled fashion to the hydrocarbon environment while reducing the oxygen content of the sands to a point where it would not exceed flammable limits. The problems relating to reducing the oxygen content and preventing escape of hydrocarbon vapours to the atmosphere may be addressed by purging with an inert gas, utilizing solids feeders and optionally an intermediate or secondary surge chamber with inert gas purge.

As a person skilled in the art would appreciate, the primary surge bin and secondary chamber may generally be operated on level control by adjusting the feed rate into and/or the discharge rate from the bin such as to maintain a certain desired level of solids in the bin. Inert gas (such as nitrogen) or other non-combustible gas (such as flue gas) may be added to the bin and/or the secondary chamber below the solids level in the chamber. A vent located above the solids level may be used to purge the oxygen content to acceptable concentrations, as would be known to one skilled in the art. An oxygen analyzer located in the vent stream may be used to control the flow of non-combustible gas into the secondary chamber.

The size-reduced, oxygen-depleted oil sands may be fed by level control through a second solids feeder to a conveyor and then to a hydrocarbon environment. In the present invention, the hydrocarbon environment may be provided in a rotary breaker where solvation occurs. A secondary oxygen analyzer (which, for example, may be positioned in the conveyor leading from the secondary or surge chamber to the rotary breaker) can be used to measure the oxygen content and to control the inert gas to the bin and/or the secondary chamber.

3. Solvent/Ore Contact-Mixing-Extraction/Further Size Reduction/Rejection of Larger Material in a Rotary Breaker The rotary breaker may perform several functions, including:

Contacting the primary size-reduced oil sands with extraction solvent to solvate bitumen. As described below, C3 to C9 paraffinic solvents, which may be freshly added and/or recycled from later processing steps, may be used.

Further reducing the size of lumps in oil sands containing bitumen during the extraction process in the rotating vessel.

Excluding large lumps. The rotating drum will have holes, and the holes may be sized to optimize performance with respect to extraction/overall recovery and to help with the rejection of larger lumps that may disrupt the uniform slurry needed for filtration, efficient washing, and primary drying stages described below.

Rotary breakers are common in the coal and oil sands industries for size exclusion mainly in water environments. However, the current process may be carried out in a hydrocarbon environment where extraction of the bitumen from the oil sands, size reduction of the primary sized material, and size exclusion all take place. Recycled solvent containing bitumen from a filtration unit operation located downstream of the settler may be used as the solvent for the incoming bitumen in the rotary breaker. Optionally, a portion of fresh solvent may also be added to the rotary breaker.

The pressure and temperature of the rotary breaker may generally be set so as to keep the solvent in the liquid state. The temperature of the operation can be carried out from about −10° C. to 100° C. depending on the solvent employed. For example, the process may be carried out using C5 solvent at about 0 to 30° C. and close to atmospheric pressure. The residence time may be about 1 to 30 minutes. Rotation speed and residence time can be changed within normal design parameters. The hole size can be from 5-50 mm.

Oil sand lumps exhibit a large variation in ability to disintegrate. Some lumps disintegrate within a minute without any agitation, even at temperatures below 0° C., while others do not disintegrate at all without agitation. The lumps that disintegrate quickly would leave the equipment quickly, decreasing the volume flow downstream of the rotary breaker and providing more residence time and agitation to the lumps that do not break down as easily. This makes the rotary breaker a suitable device for efficiently disintegrating oil sand lumps and enabling further extraction of bitumen from the sand.

The rotary breaker may be equipped with internals, such as breaker bars or lift plates, to deliver higher energy dissipation to assist in the breakdown of ore lumps, the separation of bitumen from the ore lumps and dissolution of bitumen in solvent. A person skilled in the art would understand suitable screen size holes, residence times and energy input in the breaker to achieve this.

Optionally, to enhance dissolution of bitumen and disintegration of any remaining lumps before the slurry is fed to the settler, an additional unit operation (not shown) may be included downstream of the rotary breaker and upstream of the settler. This additional unit operation may perform the following functions: (a) increase contact time between solvent, bitumen and ore; and (b) introduce additional shear/mixing energy to disintegrate any remaining oil sand lumps. For example, one or more vessels, active or passive mixing devices, pumps and/or pipelines may be used to enhance the dissolution of bitumen before the slurry is fed to the settler.

Optionally, water can be added during slurrying in the rotary breaker to increase filtration rates as explained in U.S. Pat. No. 3,542,666. Adding a base to this water to maintain a certain minimum pH may also be beneficial.

4. Transport to Next Unit Operation

A commercially-available slurry pump (centrifugal, disc, positive displacement or other) may be used to transport the output from the breaker, which comprises a slurry of dissolved bitumen in solvent and solids, to a conventional settler (sometimes called a clarifier or thickener). Material which has been size excluded (e.g. particles larger than the hole size of the rotary breaker) will exit the breaker through another outlet. The rejected particles will mainly consist of lumps and stones/rocks.

5. Liquid/Solid Primary Separation

A primary solids/liquid separation may take place in a solids-liquid separation device such as a conventional settler. Hydrocyclones may be used as an alternative for the primary liquid/solvent separation. The settler may serve multiple purposes including:

Providing residence time for the solids and liquids to separate.

Producing an overflow comprising solvent-diluted bitumen having a low ash concentration. The low ash concentration of the bitumen is beneficial for pipeline transport and for certain types of downstream upgrader bitumen processing such as hydrocracking.

Providing an underflow that has been concentrated in solids (i.e. thickened). This underflow is suitable in the filtration step because it does not classify into coarse solids and a fines-containing liquid phase.

The first-stage settler underflow may be transported to a filtration unit for washing the sands and for further removal of bitumen and desolventisation, i.e. removal of solvent.

Optionally, a second-stage settler can be employed to produce a higher quality bitumen product. Overflow from the first settler may be sent to a second settler, where it is further separated into a second overflow and an underflow. The underflow of the second settler can be mixed in homogeneously with either the first-stage settler feed or filter feed or dealt with in a tailings solvent recovery unit. The presence of a second settler may also allow for the first settler to be a much smaller size and enable utilization of much simpler settler equipment such as a deep cone settler without any moving internal parts.

The solvent-to-bitumen (S/B) ratio for the second settler can be kept consistent with the primary settler overflow S/B ratio or can optionally be increased through addition of fresh solvent in the second settler feed so as to induce more asphaltene precipitation. Asphaltene precipitation is known to aid in the removal of fine particles. The temperature of the second-stage settler can optionally be increased in comparison to the first stage to enhance settling rates, thus allowing for smaller equipment sizes. Heating up this stream is relatively easy since the bulk of the solids have been removed upstream.

6. Filtration—Solids/Liquid Separation, Washing, Desolventisation

The filtration unit may comprise several parts, including but not limited to, peripheral equipment such as a slurry feeding system, a filtrate receiver, one or more pressure vessels, feed control valves, and/or pumps. The "filtration unit" as used in the present invention includes any equipment located between the output of the settler and to the point where the filter cake is reduced in pressure and transported to the next unit operation. For example, the filtration unit may allow for solvent washing of the filter cake, and for solvent vapour desolventisation as described herein.

The filtration unit includes a filter. A feed slurry is deposited as a filter cake into the filter, on top of a filter medium. The filter cake comprises the layer of solids on top of the filter medium. The majority of the solids cannot pass through the filter medium, while liquids can pass through the filter medium. Fresh solvent and/or solvent vapour and/or other gases may be passed through the filter cake by means of an applied pressure difference between the space above the top of the filter cake and the space below the filter cake. Following passage through the filter medium, a filtrate is produced comprising a liquid stream with a certain amount of dispersed fine solids. The solids or filter cake are retained on the filter medium.

A filtration unit may serve many functions, including:

Washing the extracted oil sands and removing the remaining maltenes. The final bitumen material is upgraded by leaving behind a portion of unwanted, undissolved, asphaltenes in the solids.

Desolventising, i.e. removing solvent from the sand as a liquid.

Heating up the solids to facilitate the downstream drying operation.

In the filtration step, a thickened slurry which is produced as underflow from the settler is pumped into the filtration unit.

After loading the thickened slurry into the filtration unit, recycled solvent (or fresh make-up as required) may be fed to the filtration unit for removal of entrained bitumen left after the settling step. Counter-current washing in multiple stages may be applied to enable washing at low fresh solvent consumption.

Solvent vapour (e.g. generated during solvent recovery in the solvent recovery unit) may be introduced above the filter bed. The solvent vapour introduction can serve multiple purposes. First, the vapour can drive the majority of the solvent from the filter bed as a liquid. Second, a condensation front can be created where the solvent vapour condenses on the filter cake. This condensation front of clean solvent may be pushed through the filter cake and results in additional washing of the filter cake, and further recovery of remaining bitumen. Third, the condensing vapour may also heat up the sand in the filter cake. Fourth, after vapour breakthrough through the filter bed, vapour velocity will increase and more solvent will be removed from the bed as small liquid droplets.

Optionally, in a subsequent step, the pressure underneath the filter cake can be decreased to further reduce the solvent content of the filter cake by flashing off more solvent. Alternatively, water steam under pressure may be applied above the filter cake to heat up the filter cake and reduce the remaining solvent content. In another embodiment of the invention, solvent vapour and steam could be consecutively applied.

Finally, nitrogen gas can optionally be purged through the filter bed to even further reduce the solvent content by stripping out more solvent.

Experiments on filtration using nitrogen gas pressure to drive the solvent from the filter bed reduced solvent content from 20 wt % in the settler underflow to about 8-12 weight %.

Removing the majority of the solvent as a liquid in the filter may also help to minimize downstream erosion. Any solvent vapour generated in the filter itself will not result in erosion problems as the solids are fixed in a filter cake.

Feeding hot material from the filtration unit into the subsequent drying step simplifies the downstream drying equipment, since it should be unnecessary to introduce large amounts of heat to the solids stream. Alternative methods to heat large solids streams such as by gas flow or through direct heat exchange usually require large and potentially very expensive equipment.

The filtrate may be recycled directly to the rotary breaker.

The described filtration process could be executed in a filter (e.g. a rotary pan filter) under overpressure.

7. Transport to Drying

The solids exiting the filtration unit under pressure are transported to a dryer, which can be operated at lower pressure to facilitate evaporation of solvent. This requires reducing the pressure of the solids, and several ways of accomplishing this would be known to a person skilled in the art. For example, the solids may be dropped directly into pressure reduction vessels. These vessels may be operated in parallel in a semi-batch mode. For example, one chamber may be filling with solids from the filter while another vessel is closed to the filter. A vent valve in the chamber allows for depressurization, following which the material may be removed for final-stage drying. The vapour may be condensed, or alternatively, recovered by a scrubber or other means, and recycled to the process. The pressure inside the vessels is reduced compared to the higher-pressure within the filter, so that the pressure is below the vapour pressure of the remaining solvent in these vessels. The solids can then be unloaded from the pressure vessel onto a conveyor belt or other means of transport to the dryer.

In another example only one pressure reduction vessel is used, with an upstream storage vessel to allow for the discontinuous operation of the pressure reduction vessel.

In yet another example, dense phase conveying is used to combine the depressurization and transporting functions into one unit operation.

8. Final Solids Drying

In Canada, economic and regulatory regulations require that for water-based extraction processes, only 4 barrels of solvent can be lost per 1000 barrels of bitumen production. Similar requirements likely apply to non-water based extraction processes. Accordingly, it is beneficial to employ processes wherein the solvent is recycled.

The solids material is transported into a dryer. An inert stripping gas, such as N2, flue gas or steam, is used to remove the residual solvent from the sand. Vent produced in the dryer may be sent through a scrubber or other solvent recovery unit to recover solvent, which is recycled to the process. Entrained solids in this vent may be removed through a cyclone, bag filter or other appropriate means. Inert gas may also be recycled in this drying process. Water in the vent stream is collected separately and removed from the process.

A second-stage drying step may optionally be used to remove the residual solvent in the tailings to acceptable concentrations.

9. Reclamation: Exit of Solids From System

The dried tailings can be transported back into the original mine site or stored at another location. A small amount of water can be sprayed onto the tailings if dust becomes an issue. As is well known in the art, an issue with wet tailings is achieving sufficient consistency to enable final reclamation through covering the tailings with overburden.

The sand, which is produced as a result of this extraction process, may be used directly for landfill.

This allows for faster and potentially less expensive mine backfilling. The solids may also be mixed or agglomerated with wet mature fine tailings (MFT) from the existing water-based process, thereby reducing the proportionate amount of MFT and producing a material that may be acceptable for backfilling.

10. Solvent Recovery

The bitumen product can be recovered from the solvent-diluted bitumen overflow of the settler through conventional means like distillation or flashing. The bitumen produced must meet pipeline specifications, with regard to characteristics such as viscosity. To achieve these specifications, some solvent may be left in the bitumen product. Heat integration techniques can be applied, as will be appreciated by those skilled in the art. Where the solvent used for pipelining is different from the solvent used in the extraction process, solvent swap may be required.

FIG. 1 shows an embodiment of the present invention. In an oil sands extraction process, mined oil sands (5) from a mining operation, for example, are trucked or conveyed to a primary crusher, which may be, for example, a rotary crusher (10). The primary size reduction may be carried out by the rotary crusher on a very large scale, for example. The crusher may reduce the size of the oil sand particles or lumps to about 8-12" or less. From the crusher, the size-reduced oil sand material is conveyed via a conveyor (20) into one or more surge bins (30) and is ready for further processing.

The output from the primary surge bin (30) comprises primary size-reduced oil sands. The primary size-reduced oil sands are fed into a secondary chamber or intermediate surge chamber (45) via a solids feeder (40), which may be, for example, a Posimetric™ feeder, manufactured by Pennsylvania Crusher Corporation of Broomall, Pa. The primary surge bin (30) and the secondary chamber (45) may be operated on standard level control by controlling the feed into and out of the chamber. To reduce the oxygen content of the oil sands to a point that will not exceed flammable limits as the size-reduced oil sands are introduced into secondary chamber (45), the secondary chamber may be equipped with an inert gas purge (55) through which inert gas such as nitrogen, flue gas or other inert gas is added into the secondary chamber (45). The primary surge bin (30) and the secondary chamber (45) may be operated on standard level control.

The inert gas (55) may be added below the solids level and a vent (46) which may be located above the solids may be used to purge the oxygen content to acceptable concentrations. A person skilled in the art would be able to determine suitable oxygen concentrations without undue experimentation. An oxygen analyzer located in the vent stream may be used to control the flow of non-combustible gas to the secondary chamber.

As a result of the inert gas purge, the primary size-reduced oil sands that exit the secondary chamber (45) will be oxygen-depleted. The oxygen-depleted, primary size-reduced oil sands exiting the secondary chamber (45) are then fed by level control through a second solids feeder (50) to a conveyor (60). The second solids feeder (50) may be, for example, a Posimetric™ feeder. A secondary oxygen analyzer may be used to measure the oxygen content during conveying, before introduction into the solvent environment within the rotary breaker (80). For example, the secondary oxygen analyzer may be present in a conveyor (60) which may lead from the secondary feeder (50) to the rotary breaker (80).

The output from conveyor (70) may be fed into a rotary breaker (80), which may be, for example, a rotating drum-like vessel with size exclusion/classifying capability. The size exclusion/classifying capability may be accomplished by holes within the drum, which rejects lumps larger than the hole size. For example, lumps and rocks larger than about 2" or larger may not pass through the holes and are rejected from the primary material. In one embodiment, lumps larger than about 0.5" in diameter are not passed through the breaker and are rejected from the primary material. A person skilled in the art would be able to determine the hole size to optimize performance and ensure uniform slurry for later processing steps.

Following the classification through the breaker, larger lumps and rocks (e.g., >0.5") are rejected (105) and may be sent to a dryer (320), while the output from the breaker (90) comprising dissolved bitumen in solvent and smaller sands may be sent to the next unit operation via a slurry pump (100). Recycled solvent (115) containing bitumen and which has been recycled from the filtration unit operation may be injected into the rotary breaker (80). Optionally, a portion of recycled or fresh solvent (125) can also be added to the rotary breaker (80). The target S/B ratio of the solvent-diluted bitumen for the process may be set at the overflow of the primary settler (135). For example, a target S/B ratio of 1 to 5 may be used. As would be appreciated by a person skilled in the art, the target S/B ratio may be determined by on-line analysis.

In order to keep the solvent in the rotary breaker in liquid state, temperature and pressure may be controlled. The temperature may be, for example, about −10 to about 100° C. depending on the solvent. For example, with a C5 mixture, the process may be carried out close to atmospheric pressure, or a temperature of about 0 to about 30° C. The residence time may be about 1 to 30 minutes. A person skilled in the art would be able to determine suitable pressure, temperature and residence times.

Optionally, water (126) can be added during slurrying in the rotary breaker to increase filtration rates as explained in U.S. Pat. No. 3,542,666. A base may also be added to the water to maintain a certain pH.

The output from the rotary breaker (90) which comprises bitumen dissolved in solvent may be transported via a slurry pump (100) which may be, for example, a centrifugal, disc, positive displacement or other device, to a conventional settler (120) via line (110). The settler (120) may also be referred to as a clarifier or thickener.

Primary solids/liquid separation may take place in a solids-liquid separation device such as a settler (120). The settler can also produce solvent-diluted bitumen as overflow (135). This overflow usually has a low ash concentration. The settler can also produce an underflow (130) that may be concentrated in solids, such as a thick slurry. The thickened underflow may assist in subsequent filtration steps by preventing classification.

The first-stage settler underflow (130) may be transported by a slurry pump (140), which may be, for example, a centrifugal, disc, or positive displacement pump to a filtration unit (160) for washing the oil sands for removal of additional bitumen and solvent, prior to further solids desolventisation.

Optionally, the overflow (135) of the primary settler (120) can be sent to a second stage settler (195). When a second settler is used, the primary settler (120), or alternatively a hydrocyclone, may remove the majority of the solids through the underflow (130), while the secondary settler may be used to produce a higher quality overflow product which is lower in ash content. The underflow of the second settler can be mixed in homogeneously with either the primary settler feed or filter feed, or dealt with in a tailings solvent recovery unit.

Optionally, chemical addition may be introduced into the first and/or second settler to aid in sequestering fines and asphaltenes.

The filtration unit (160) may comprise a filter (170) suitable for filtration of thick slurries, such as a moving belt, moving pan filter or a rotary filter.

After loading the thickened slurry into the filtration unit (160), recycled solvent from tank (410) (or fresh make-up (400) from tank (370) to account for any solvent losses in the process if required) may be fed to the filtration unit (160) to assist in the removal of entrained bitumen left in the thick slurry following the settling step. The filtration step can also be staged and carried out in a counter-current fashion. Following addition of solvent (220), solvent vapour generated during solvent recovery (228) in the solvent recovery unit (460) may be introduced above the filter bed.

Optionally, the filter system may comprise separate pieces of equipment. The first piece of equipment (i.e. the first stage filter) would allow for the filtrate cake to be washed. The output from the first-stage filter, which may comprise hot material, may discharge into a second-stage filter or optional piece of equipment that would allow for solvent vapour desolventisation. In the filtration unit (160), the thick slurry (130) exiting the settler (120) may be separated into a solids portion (180) and a filtrate output (115). The filtrate output (115) from the filtration unit may be recycled directly to the rotary breaker as the solvent feed.

The solids (180) may exit the filtration unit (160) under pressure and be dropped into one or more pressure reduction vessels (182). The solids may enter the chambers by gravity through a valve, for example, and exit the chamber after pressure reduction by gravity through a second valve located on the bottom of the pressure reduction vessels (182). Valves (175) which may be suitable for this application include a Dome Valve™ produced by Macawber Engineering Inc. of Maryville, Tenn.

Inside the vessels, the pressure may be reduced from a higher-pressure environment such as in the filtration unit to a pressure below the vapour pressure of the remaining solvent. The number of vessels required to accomplish this depends on the size of the application. The person skilled in the art would be able to determine a suitable number of vessels with routine experimentation. The vapour may be condensed, for example in a condenser (380) with accumulator (390), or alternatively recovered by a scrubber, and recycled for further use. The solids can then be conveyed by belt (184) or other means to a final dyer (250) and introduced to the dryer via a solids feeder.

As an alternative to the pressure reduction vessels, continuous rotary valves may be used, or a column of solids to seal between the high and low-pressure environments may be used. In all cases, the depressurized material would be removed for final-stage drying.

In another example, dense phase conveying is used to combine the depressurization and transporting functions into one unit operation.

The final dryer (250) may remove solvent from solids to very low concentrations (<400 ppmw) and produce dry tailings. A commercially available Wyssmont Turbofan Dryer™ may be used for the final drying step.

The vent from the dryer may be sent through a standard cyclone (255) and/or dust filter to remove entrained solids from the solvent/inert gas stream. The material may then be sent through a scrubber (260) or other solvent recovery unit to recover the solvent and recycle the inert gas for further use. For example, the inert gas may also be recycled to the secondary chamber (45). The scrubber (260) bottoms containing the solvent and scrubbing medium is sent to a distillation column (270) where solvent is recovered as the overhead product and recycled to the process. The solvent is condensed and recovered in accumulator (280). Water can be collected in a boot on the accumulator (280) and removed from the process or used for dust prevention in reclamation. Recovered solvent (350) may be sent to solvent recovery tank (410). The column bottoms are returned to scrubber (260).

The depressurized solids material may exit the dryer (250) through a feeder (330). Alternatively, large rotary valves, or a column of product above a feeder to seal the low differential pressure may be used.

The overflow (135) from the primary settler, or optionally the overflow (198) from the secondary settler, may be sent to a solvent recovery column (460), which may be a conventional distillation column, for example. The overhead-recovered solvent produced from the column can be recycled to the filtration unit, as a vapor (228). Condensed material is collected in an accumulator (440) equipped with a boot for water removal from the process. The recovered solvent (420) may also be recycled via recovered solvent tank (410). The bottoms material from the column (455) contains the low-ash bitumen product.

The dry tailings (340) are produced following the final stage of drying. Additional water (360) may be added to the tailings to control dust.

The dry tailings may be conveyed by belt or trucked to the original mine site for introduction into the mine site. Alternative conveying methods such as dense or dilute phase conveying may also be used.

EXAMPLES

1) Use of Settler

A number of settling experiments were performed to illustrate that a bitumen product with low ash content can be produced. Two different sets of experiments were conducted.

In the first set of experiments, a single-stage settler line-up was simulated. First, a bitumen-preloaded solvent was prepared to mimic the solvent/bitumen mixture from the filter that is used for contacting the ore in the rotary breaker in the process described above. This preloaded solvent was poured directly into a glass settling cylinder of 2.2 m length and 50 mm diameter and an amount of fresh ore was added to this solvent.

The solvent/ore within the settling cylinder was then mixed through rotating the cylinder around its central axis, in an end-over-end fashion, for 5 minutes until adequate mixing was achieved. After the mixing, the rotation was stopped and the solids were allowed to settle. Referring to Table 1, a series of samples was taken via a series of valves along the side of the settling cylinder. All samples were taken from a selected valve chosen for close proximity to the liquid just above the interface between coarse sand and liquid with fines. The liquid level in the settling cylinder dropped with each sampling. A settling velocity was calculated based on the distance between the top liquid level and the sampling valve and the time at which the sample was taken. When sampling began the liquid was murky due to the presence of fines, but by the time that sample 3.3 was taken in the first experiment (see below), sufficient time had elapsed for the fines to settle and the liquid was generally clear.

Table 1 shows the results of three experiments performed for different ore grades and at different S/B ratios of the final solvent/bitumen mixture. As is apparent from the results, in all cases bitumen with low ash content was produced. Settling velocities from about 3-11 cm/min may result in bitumen with ash content below 0.1 wt %.

TABLE 1

Settling of bitumen, solvent, solids mixtures from different ore grades at different solvent to bitumen ratios.

| S/B Wt | Ore grade wt % | Sample No | Time (min) | Settling velocity cm/min | Ash measurement ASTM D482 % w | Settling velocity to achieve <0.1 wt % ash cm/min |
|---|---|---|---|---|---|---|
| 4.1 | 5.6% | 3.1 | 7.0 | 8.4-6.6 | 8.290 | 3.0-4.8 |
| | | 3.2 | 7.6 | 6.6-4.8 | 5.700 | |
| | | 3.3 | 8.2 | 4.8-3.0 | 0.199 | |
| | | 3.5 | 8.8 | 3.0-1.2 | 0.042 | |
| | | 3.6 | 9.3 | <1.2 | 0.046 | |
| 2.8 | 10.6% | 4.1 | 5.0 | 10.1-8.3 | 0.15 | 4.6-8.3 |
| | | 4.2 | 5.7 | 8.3-6.5 | 0.039 | |
| | | 4.3 | 6.4 | 6.5-4.6 | 0.103 | |
| | | 4.4 | 7.1 | 4.6-2.8 | 0.04 | |
| | | 4.5 | 7.8 | 2.8-1.0 | 0.065 | |
| 4 | 10.6% | 5.1 | 5.0 | 11.0-9.0 | 0.195 | 7.1-11.0 |
| | | 5.2 | 5.5 | 9.0-7.1 | <0.001 | |
| | | 5.3 | 6.0 | 7.1-5.1 | 0.037 | |
| | | 5.4 | 6.5 | 5.1-3.1 | 0.024 | |
| | | 5.5 | 7.0 | 3.1-1.1 | 0.035 | |
| | | 5.6 | 7.5 | <1.1 | 0.018 | |

In a second series of experiments, a two-stage settler line-up was simulated. Oil sand was mixed with solvent (C5) in a flask with the aim of achieving a set S/B ratio. After mixing, the coarse solids settled and the solvent/bitumen mixture was poured off. A limited amount of the coarse solids were included with the liquid to help ensure that all fines in the supernatant liquid were maintained in the liquid that was poured off. This liquid was then poured into a polycarbonate cylinder of 2 m length and 25 mm diameter, the top of the cylinder was closed and the solvent, and fines and coarse material were re-dispersed by agitating the cylinder. The cylinder was then positioned vertically. The cylinder lid was removed and samples were taken from the top using a sampling tube.

In the first experiment, samples of the liquid were taken near the top of the liquid level in the cylinder after 5, 15, 30, 45 and 60 minutes of settling. Initially, the liquid was murky but cleared following settling of the fines. The top liquid level dropped by 30 cm at each sampling due to the withdrawal of the sample. In the second experiment, samples were taken with the sample tube placed just above the liquid/solid interface level in the cylinder after 5, 10, 15, 20 and 35 minutes of settling. The results are shown in the Table 2. Bitumen with low ash content was produced. In both experiments settling velocities are above the maximum measurable in the given set-up, i.e. 6 cm/min in the first experiment and 26 cm/min in the second experiment. However, the results in Table 2 illustrate the added utility of the two-stage settler line-up.

TABLE 2

Bitumen recovery from different ore grades using a two-stage settler simulation.

| Experiment | S/B | Ore grade wt % | Sample No. | Time (min) | Settling velocity cm/min | Ash measurement ASTM D482 % w |
|---|---|---|---|---|---|---|
| 1 | 2.3 | 10.6% | 4.1 | 5 | >6 | 0.0316 |
| | | | 4.2 | 15 | 2-6 | 0.0328 |
| | | | 4.3 | 30 | 1-2 | 0.0324 |
| | | | 4.4 | 45 | 0.67-1 | 0.0367 |
| | | | 4.5 | 60 | <0.5 | 0.0391 |
| 2 | 5.3 | 10.6% | 5.1 | 5 | >26 | 0.0250 |
| | | | 5.2 | 10 | 26-11 | 0.0184 |
| | | | 5.3 | 15 | 11-6 | 0.0202 |
| | | | 5.4 | 20 | 6-4 | 0.0227 |
| | | | 5.5 | 30 | 4-2 | 0.0130 |
| | | | 5.6 | 35 | 2-1 | 0.0375 |

2) Filtration Experiments

While a low ash bitumen product may be produced from a settler alone, the underflow of the settler still contains sand, solvent and bitumen, which may be further separated in order to recover additional bitumen. Thus, additional experiments using filtration were conducted.

i) Influence of Slurry Solids Concentration and Filter Outlet

It was observed during experiments that filtration rates were sometimes lower due to high filtration resistance or the filter cake becoming blocked. Closer investigation revealed that the solids concentration in the slurry can have an influence on the filtration performance. Due to the settling behaviour of the coarse material in the slurry, classification may take place almost immediately after slurry feeding on top of the filter surface. The fines dispersed in the liquid layer above the coarse solids can form a layer on top of the filter cake with a much higher filtration resistance than the coarse sediment; this can lead to very slow filtration rates or even complete blocking of the filter cake.

Another parameter that may be of importance depending factors such as ore quality is whether the outlet of the filter is open or closed during feeding the slurry. It has been observed that having an open filter outlet can enable surplus liquid present in the slurry to pass more readily through the filter medium, thus helping to prevent building up a supernatant liquid layer with fines and eventually a blocking layer of fines on top of the filter cake.

Table 3 shows the results of filtration experiments on two different feed types. In Table 3, "t1" represents the time from beginning of feeding until the filter cake becomes visible. "t Wash" represents the time between filling in of wash liquid until the filter cake becomes visible again. The pressure difference across the filter cake was applied by pressurized gas above the filter cake.

TABLE 3

Filtration experiments using two different types of filter feed.

| Test No. | A | B | C | D |
|---|---|---|---|---|
| Sand/g | 401 | 400 | 402 | 400 |
| Solvent/g | 171 | 170 | 145 | 144 |
| Solvent type | C5 | C5 | C5 | C5 |
| Slurry Input/g | 562.9 | 560 | 541.7 | 440.8 |
| Dp/bar | 0.3 | 0.3... | 0.3 | 0.3 |
| tl/s | ? | 5 > 300 | 66 | <5 |
| Wash solvent/g | 81 | Wash not possible | — | — |
| t Wash/s | 10.7 | — | — | — |
| Mass Decantate/g | | | | 94.7 |
| Slurry solids content/wt % | 59.1% | 59.1% | 61.9% | 75.0% |
| S/B | 3.5 | 3.5 | 3.5 | 3.5 |
| Sand Type | a2 | a2 | Bench 11.05.09 | Bench 11.05.09 |
| Filter outlet | Open | Closed | Open | Open |
| Comment | | Blocked | Very long cake formation time tl, very low filtration rate | |

As experiment C demonstrates, almost complete blockage of the filter occurred, with very long cake formation time and a very low filtration rate (even though the outlet was open during filling). Increasing the slurry solids concentration (experiment D), however, resulted in improved filtration performance. Experiment B demonstrated that at a slurry solids content of 59.1% blocking of the filter cake occurred; however, this blocking was avoided in a subsequent run at the same solids concentration by opening the filter outlet during slurry filling (experiment A).

ii) Solvent Type

Table 4 shows the results of filtration experiments with different solvents. Table 4 illustrates that filtration with the paraffinic solvents was successful while filtration using an aromatic solvent exhibited slow filtration rates and high ash content in the filtrate. Aromatic solvents resulted in all of the asphaltenes being dissolved. Paraffinic solvents only partially dissolved the asphaltenes. Non-dissolved asphaltenes may aid in agglomeration of the fine particles, and thereby improve the filtration behaviour.

Open funnel vacuum filtration experiments were conducted with a 0.025 μm filter element. Filtration was undertaken with slurry mixtures using ore of 5.6 wt % bitumen content and toluene, pentane or heptane, at ambient conditions:

TABLE 4

Bitumen production using different solvents.

| Test | FD* Mm | Solvent | Ore gr | Solvent Gr | SD** | Filtration results | Ash*** ASTM D482 % w |
|---|---|---|---|---|---|---|---|
| 1 | 47 | Toluene | 25 | 11 | | Very slow but no blocking | |
| 2 | 47 | Pentane | 25 | 11 | | Runs, no blocking | 0.0232 |
| 4 | 90 | Toluene | 50 | 22 | | Very slow, 16 hours | 0.3920 |
| 5 | 90 | Pentane | 25 | 50 | y | Runs, no blocking | |
| 6a | 90 | Heptane | 25 | 50 | y | Good | 0.0251 |
| 6b | 90 | Heptane | 25 | 50 | y | Good | |

*FD = Filter diameter
**SD = Solvent decanted
*** = Ash measurement

Although the foregoing invention has been described in some detail by way of illustration and example for purposes of clarity of understanding, it is readily apparent to those of ordinary skill in the art in light of the teachings of this invention that certain changes and modifications may be made thereto without departing from the spirit or scope of the appended claims.

The citation of any publication, patent or patent application is for its disclosure prior to the filing date and should not be construed as an admission that the present invention is not entitled to antedate such publication, patent or patent application by virtue of prior invention.

It must be noted that as used in the specification and the appended claims, the singular forms of "a", "an" and "the" include plural reference unless the context clearly indicates otherwise.

Unless defined otherwise all technical and scientific terms used herein have the same meaning as commonly understood to one of ordinary skill and the art to which this invention belongs.

We claim:

1. A method for extracting bitumen from an oil sand, the method comprising:

contacting an oil sand with a solvent to generate a solvated oil sand slurry, wherein the solvent is a C3 to C9 paraffinic solvent, or a mixture thereof;

separating solvent-diluted bitumen from the solvated oil sand slurry to generate (a) a solvent-diluted bitumen and (b) a slurry with increased solids concentration, the increased solids concentration being between 60 and 85 percent by weight solids;

filtering the slurry with increased solids concentration;

adding solvent vapour above the filter bed to produce solids, and a filtrate output; and drying the solids resulting from the filtering to produce solids having dry tailings.

2. The method of claim 1, further comprising size-reducing the oil sand to produce a size-reduced oil sand feed.

3. The method of claim 1 wherein the solvent is a C5 solvent.

4. The method of claim 1 wherein the separating step is carried out in a settler.

5. The method of claim 1 wherein at least some of the solvent in either or both of the solids and the filtrate is recovered and recycled to either or both of the contacting step and the filtering step.

6. The method of claim 1 wherein at least some of the filtrate is recycled to the contacting step.

7. The method of claim 1 further comprising heating the solids during the filtering step.

8. The method of claim 1 wherein at least some of the solvent in the solvent-diluted bitumen is recovered and recycled to either or both of the contacting step and the filtering step.

9. The method of claim 1 further comprising feeding overflow from the separating step to a second separating step.

10. A method for extracting bitumen from an oil sand, the method comprising:

reducing the size of an oil sand feed to produce a size-reduced oil sand feed;

adding to the size-reduced oil sand feed to form a slurry a solvent, wherein the solvent is a C3 to C9 paraffinic solvent, or a mixture thereof;

feeding the slurry to a separation device;

allowing the slurry to be separated into a solvent-diluted bitumen and an underflow containing between 60 and 85 percent by weight solids;

feeding the underflow to a filtration unit;

introducing solvent vapor above the filter bed of the filtration unit:

recovering a filtrate from the filtration unit;

recovering the solids from the filtration unit; and recovering solvent from the solids from the filtration unit by drying the solids wherein produce dry tailings are produced.

11. The method according to claim 10, wherein at least some of the solvent in either or both of the solids and the filtrate is recovered and recycled to either or both of the step of adding solvent to the size-reduced oil sand feed to form a slurry, and the filtration unit.

12. The method according to claim 10, wherein at least some of the filtrate is recycled to the step of adding solvent to the size-reduced oil sand feed to form a slurry.

13. The method of claim 10 further comprising heating the solids in the filtration unit.

14. The method according to claim 10, wherein at least some of the solvent in the solvent-diluted bitumen is recovered and recycled to either or both of the step of adding solvent to the size-reduced oil sand feed to form a slurry and the filtration unit.

15. The method of claim 10 further comprising depressurizing the solids from the filtration unit to recover additional solvent.

16. The method of claim 10 further comprising desolventising the underflow within the filtration unit.

17. The method of claim 10 further comprising drying the solids from the filtration unit to produce dry tailings.

18. The method of claim 10 comprising adding solvent to the oil sand feed using a rotary breaker.

19. The method of claim 10 wherein the solvent is a C5 solvent.

20. The method of claim 10 further comprising purging with an inert gas while introducing the oil sand into a hydrocarbon atmosphere.

21. The method of claim 10 wherein washing of the solids is carried out in the filtration unit.

22. The method of claim 10 further comprising feeding the solvent diluted bitumen from the separation device to a second separation device.

23. The method of claim 10 wherein the separation device comprises a settler.

24. The method of claim 1 wherein at least a portion of the solvent vapour added above the filter bed condenses in the filter bed.

25. The method of claim 10 further comprising the step of condensing at least a portion of the solvent vapor that was introduced above the filter bed.

* * * * *